United States Patent [19]

Fish

[11] Patent Number: 4,518,490

[45] Date of Patent: May 21, 1985

[54] REMOVAL OF ARSENIC COMPOUNDS FROM PETROLIFEROUS LIQUIDS

[75] Inventor: Richard H. Fish, Berkeley, Calif.

[73] Assignee: The United States of America as represented by the United States Department of Energy, Washington, D.C.

[21] Appl. No.: 597,627

[22] Filed: Apr. 6, 1984

[51] Int. Cl.[3] ..... C10G 25/00

[52] U.S. Cl. ..... 208/251 R; 208/11 R

[58] Field of Search ..... 208/251 R, 11 R; 585/820, 824, 830

[56] References Cited

U.S. PATENT DOCUMENTS

| | | | |
|---|---|---|---|
| 3,023,161 | 2/1962 | Luvisi et al. | 208/251 R |
| 3,468,790 | 9/1969 | Deschamps et al. | 208/251 R |
| 3,791,968 | 2/1974 | Whitehurst et al. | 208/251 R |
| 3,838,043 | 9/1974 | Crook et al. | 208/251 R |
| 4,136,021 | 1/1979 | Whitehurst | 208/251 R |

OTHER PUBLICATIONS

Doak et al., "Organometallic Compounds of Arsenic, Antimony, and Bismuth", pp. 42–43.

*Primary Examiner*—Delbert E. Gantz
*Assistant Examiner*—Anthony McFarlane
*Attorney, Agent, or Firm*—Harold M. Dixon; Roger S. Gaither; Judson R. Hightower

[57] ABSTRACT

Described is a process for removing arsenic from petroliferous derived liquids by contacting said liquid at an elevated temperature with a divinylbenzene-crosslinked polystyrene having catechol ligands anchored thereon.

Also, described is a process for regenerating spent catecholated polystyrene by removal of the arsenic bound to it from contacting petroliferous liquid as described above and involves:

a. treating said spent catecholated polystyrene, at a temperature in the range of about 20° to 100° C. with an aqueous solution of at least one carbonate and/or bicarbonate of ammonium, alkali and alkaline earth metals, said solution having a pH between about 8 and 10 and, b. separating the solids and liquids from each other. Preferably the regeneration treatment is in two steps wherein step (a) is carried out with an aqueous alcoholic carbonate solution containing lower alkyl alcohol, and, steps (a) and (b) are repeated using a bicarbonate.

7 Claims, No Drawings

REMOVAL OF ARSENIC COMPOUNDS FROM PETROLIFEROUS LIQUIDS

The invention disclosed herein arose at the Lawrence Berkeley Laboratory in the course of, or under Contract No. DE-AC03-76SF00098 between the U.S. Department of Energy and the University of California.

FIELD OF THE INVENTION

The present invention relates to the removal of arsenic from petroliferous derived liquids. More particularly, in one aspect, this invention relates to the removal of arsenic compounds from shale oil, shale retort waste water, SRC, and petroleum by contacting same with a catecholated polymer. In another particular aspect, this invention relates to the regeneration for reuse of the catecholated polymer by the removal of arsenic compounds bound to said polymer of catecholated divinylbenzene crosslinked polystyrene.

BACKGROUND OF THE INVENTION

Shale oil, because of its manner of formation, its history and its origin contains high concentrations of trace arsenic compounds. Coal also contains relatively large amounts of arsenic but generally less than shale oil. Other petroliferous deposits generally contain some arsenic but contain greater amounts of other metals and/or metalloids and less arsenic than shale or coal. The ever decreasing supply of conventional petroleum and reserves is forcing us to consider oil shale, heavy petroleum and other petroliferous deposits in lieu of the declining traditional petroleum supplies.

In the refining of petroleum, shale oil, SRC, or other petroliferous derived liquid, catalysts are employed that are readily poisoned by trace metals such as arsenic, nickel and vanadium which are naturally present in the liquid. Examples and particularly sensitive catalysts are those in hydrogenation operations such as hydrocracking and hydrotreating or hydrofinishing catalysts. Such catalysts are very expensive and under normal circumstances can be expected to, and economics require that they perform efficiently for very long periods of time. Typical durations of such long catalyst lives are two and three years. The catalyst load in a reactor of refining size varies, but with refining capacities frequently exceeding 50,000 Bbl/day, can easily exceed several hundred thousand pounds. At present the most commercially acceptable method of protecting hydroprocessing catalyst is by placing a sacrificial bed of similar material (eg. Ni-Mo) or guard case ahead of such catalyst beds. Thus an alternative and economically acceptable method of protecting and preserving these and other refining catalysts from poisoning must be found if sources high in arsenic such as shales, coal and heavy petroleum crudes are to be used to supply significant quantities of our energy needs.

In addition to the foregoing problems, waste water is produced by oil shale retorting. These waste waters originate from mineral dehydration, combustion, groundwater seepage, and steam and moisture required in the input gas. Due to intimate contact with the shale and shale oils, these constitute a leachate containing various of the trace metals and metalloids in one form or another. The shortage of water, particularly in the western areas of the U.S. where the largest and richer deposits of shale is found, makes it important that toxic materials such as arsenic be removed from water effluent from oil shale retorting.

Accordingly, it is a principal object of the present invention to provide an effective method of removing arsenic from liquids derived from petroliferous deposits.

It is another object to provide an effective method of removing various arsenic compounds from shale oils.

It is an important object to provide an efficient, economical process for not only removing arsenic compounds from petroliferous derived liquids, but for regenerating the arsenic binding or removing agent for repeated reuse.

Yet, another object is to provide a method of removing arsenic compounds in a fashion whereby separation from the petroliferous derived liquid can be achieved in a facile, efficient and economical manner.

Still another object is to provide a method of removing arsenic compounds in their various forms (i.e. as both organic or inorganic compounds) from petroliferous derived liquids.

Other objects and advantages of the present invention will become apparent or be realized from the description herein taken as a whole or from practicing the invention.

SUMMARY OF THE INVENTION

The present invention in one aspect comprises a process for removing arsenic from petroliferous derived liquids by contacting said liquid with a divinylbenzene-crosslinked polystyrene polymer (i.e. PS-DVB) having catechol ligands anchored to said polymer, said contacting being at an elevated temperature.

In another aspect, the invention is a process for regenerating spent catecholated polystyrene polymer by removal of the arsenic bound to it from contacting petroliferous liquid in accordance with the aspect described above which regenerating process comprises:

(a) treating said spent catecholated polystyrene polymer with an aqueous solution of at least one member selected from the group consisting of carbonates and bicarbonates of ammonium, alkali metals, and alkaline earth metals, said solution having a pH between about 8 and 10, and said treating being at a temperature in the range of about 20° to 100° C.;

(b) separating the solids and liquids from each other.

In a preferred embodiment the regeneration treatment is in two steps wherein step (a) is carried out with an aqueous alcoholic carbonate solution which includes at least one lower alkyl alcohol, and, steps (c) and (d) are added. Steps (c) and (c) comprise:

(c) treating the solids with an aqueous alcoholic solution of at least one ammonium, alkali or alkaline earth metal bicarbonate at a temperature in the range of about 20 to 100° C.; and, (d) separating the solids from the liquids.

DESCRIPTION OF THE PREFERRED EMBODIMENTS

Definitions

PS-DVB is an acronym for polystyrene crosslinked with divinyl benzene, a divinyl benzene crosslinked polystyrene, or other variation of names for such polymer.

By the term "spent" catecholated polymer as used herein is meant PS-DVB which has been contacted with petroliferous derived liquid containing arsenic contaminants whereby its adsorptive or reactive potential with said contaminants are reduced if not substantially exhausted.

By arsenic or arsenic compounds is meant both organic and inorganic compounds. Specific arsenic compounds which serve as examples of such compounds found in petroliferous liquids are methylarsonic acid, phenylarsonic acid and arsenic acid.

By petroliferous derived "liquids" is meant a material which is the whole or part of a shale oil, SRC (i.e. Solvent Refined Coal by SRC Processes I or II) or conventional petroleum and heavy crude which is liquid at normal operating conditions of this process or is liquified in some fashion, for example using a solvent. The liquid can contain substantial amounts of water.

Discussion of the Polymer Anchored Ligand

The catechol ligands which react or coordinate with the arsenic compounds to bind same (i.e. chemisorption) are anchored to a PS-DVB polymer. The degree of crosslinking of the polystyrene can vary substantially although the degree of crosslinking is quite important. The degree of crosslinking is important because the percentage of loading potential or quantity of catechol ligands which can be anchored to the polymer substrate varies inversely to the degree of crosslinking. Also, lower crosslinking enables the polymer to swell in the dearsenation operation discussed herein and thereby diffuse the ligand anchor points making them more accessable.

The crosslinking of polystyrene with divinylbenzene can vary up to about 20% or even higher of the crosslinker. However, in order to have higher loading of ligand onto the polymer the percentage of crosslinking can be as low as about 1% but preferably is in the range of about 2–10%. At about 2–10% crosslinking the loading of catechol ligands on polymer is in the range of about 30 to 5% respectively.

As to particle size of the polymer, that too can vary considerably. However, because surface area is important to provide for contact of the ligands with the arsenic in the liquid, and because smaller particle sizes provide a larger surface area, they are generally preferred. For example a particle size in the range of about 0 to 400 mesh (equals about 200–50 microns respectively) have been found suitable for dearsenation. Although both smaller and larger particles can be used, in most cases the foregoing range will be selected based on overall considerations. It has been found that polymer particles in the form of beads are advantageous and accordingly that form is to be preferred in most cases.

The process for the preparation of the catecholated polymer is known in the art; however, for completeness a process of preparation will be briefly described here. A commercial PS-DVB is first chloromethylated in known or conventional fashion using a stannic chloride catalyst at about 15° to 25° C. and at substantially ambient pressure for about 60 minutes. In lieu of the foregoing preparation, chloromethylated PS-DVB is commercially available and can be purchased, for example, from the Dow Chemical Company of Midland, Michigan. The chloromethylated polystyrene is used for reaction with catechol in the presence of $SnCl_4$ as catalyst at about 80° to 100° C. and substantially ambient pressure for about 2 days. Thus, catechol ligands are attached to the polymer through a methylene moiety which has been previously attached to the polymer by the chloromethylation.

Discussion of the Dearsenation of Petroliferous Liquids

The temperature of contacting petroliferous derived liquids for chemisorption of arsenic, or to bind the arsenic to the catechol ligands is a sensitive parameter as to kinetics or reaction rate at least. The higher temperatures favor a faster rate of reaction and of binding of the arsenic to the catechol ligand and thus dearsenation should be carried out at elevated temperatures. However, as a practical matter solvents such as hydrocarbons; for example, benzene, toluene, cychohexane or petroleum distillate fractions will be found advantageous to obtain a good working viscosity of the oil. Such solvent in turn will provide a good overall operating temperature for the dearsenation. As an example benzene used as a solvent provides a good temperature by operating at reflux of the benzene which is about 80° C. Thus, it is also apparent that a dearsenation temperature on the order of 80° C. can serve as a suitable temperature using other hydrocarbon solvents. Temperatures of at least about 20° C. and higher can be employed, however usually the temperature is at least about 35° C. Although temperatures above about 80° C. can be used, for example about 140° C., there is generally little or no technical advantage to temperatures above about 80° C., and particularly not sufficient to offset the measures required for heating to such higher temperatures. Preferred temperatures in most cases will be in the range of about 60–80° C.

Unlike the organic or oil-based petroliferous derived liquids where pH has little meaning or significance, when the liquid contains large quantities of water (eg. such as retort water), the pH of the water phase should be about 6 or less for the dearsenation.

The pressure in this dearsenation step and in both of the treating steps for regeneration described herein can be subatmospheric or superatmospheric. However, atmospheric or substantially ambient pressure will generally be preferred in all three operations because results at that pressure are good and the additional costs of using different pressures are usually not sufficiently compensated for by the results.

Following the dearsenation operation the spent catecholated polymer is then separated and recovered with, the arsenate contaminant bound thereto.

The spent catecholated polymer can be readily recovered following the arsenation treatment by any conventional means such as by filtering. This is also true of the dearsenated polymer following regeneration described herein. This convenient recovery after either operation is made possible by the combination of properties of the catecholated polymer. The catecholated polymer is a solid by reason of the polymer and thus insoluble in both the petroliferous liquid in the dearsenation treatment and the basic aqueous alcohol solution in the regeneration of the spent polymer. Nevertheless, the catechol ligand appendages have a degree of solubility or wettability which allows them to react and function to dearsenate the petroliferous liquid on the one hand and in turn to be sufficiently wettable by the basic aqueous solution (especially with alcohol included) to be itself dearsenated in the regeneration step. In the recovery operations the solid nature of the polymer substrate allows for filtration while the wettable catechol ligand or tails provide for the necessary contact and reaction with the respective liquids.

Regeneration of Catecholated Polymer

The regeneration of the spent polymer for reuse can be readily achieved and approaching quantitative results. The regeneration can be carried out by a treatment which comprises treating or washing the spent polymer with a basic carbonate or bicarbonate solution; or, preferably, an aqueous alcoholic solution of at least one carbonate or bicarbonate of ammonium, alkali and alkaline earth metals is used.

Regeneration temperatures of at least about normal room temperatures (i.e. about 20° C.) and higher can be employed, however usually the temperature is at least about 35° C. Although temperatures above about 80° C. can be used; for example, about 100° C., there is generally little or no technical advantage to temperatures above about 80° C. and particularly not sufficient to offset the additional expense of heating to such higher temperatures. Temperatures in the range of about 45° to 65° C. are preferred.

Alcohol imparts a highly superior efficacy to the solution and the inclusion of alcohol constitutes a preferred embodiment. The alcohol employed must be highly water soluble and for that reason will usually involve at least one lower alkyl alcohol such as, methanol, ethanol or propanol. The aqueous solution however must have an alkaline or basic pH, with or without alcohol, to be very effective. The basic or alkaline agents suitable for obtainment of the pH feature are the carbonates and bicarbonates of ammonium, alkali and alkaline earth metals. Examples of the alkali and alkaline earth metals are Na, K, Li, Ca, Mg and Ba. However, because of solubility considerations, the more preferred metals are the alkali metals with Na and K being most preferred.

It has been found that either treatment by the carbonate or the bicarbonate can be used with substantial success, however, a two-step treatment is highly advantageous. The two-step treatment is carried out by a first treatment with a carbonate at one pH and then a second treatment with a bicarbonate at a different pH. This is described in detail below.

The pH in the first step using the carbonate can be in the range of about 8 to 10 but preferably is about 9. The pH in the second treatment using the bicarbonate can be in the range of about 8 to 9 but preferably the pH in this treatment is in the range of about 8. The pH of each step is quite important and therefore the two treatments with the aqueous carbonate and alcohol and the aqueous bicarbonate and alcohol must be carried out separately for best results. While the regeneration procedes smoothly and yields very good results, one cautionary note is in order. The pH should not ever be allowed to exceed about 10 in the regeneration as such will cause oxidation of the catechol ligands on the polymer. The oxidized product can be reduced back to the catechol but this adds expense. Further the oxidation can be substantially avoided and the reduction is made unneccessary when proper pH is used in the regeneration. Thus, it should also be noted that the pH of the solutions tend to be higher when alcohol is added.

The aqueous alkaline treatment (preferably with alcohol included) can be carried out using a wide range of aqueous alkaline alcohol solution to spent polymer on a volume basis. Sufficient aqueous alkaline solution or aqueous alkaline alcohol solution will be employed to serve as a carrier for the arsenic compounds removed in the treatment but not so much as to provide for excessive dilution and to require processing of unduly large quantities of the respective aqueous solution for reuse. Usually an amount required to cover the spent catalyst placed in a container will be found satisfactory.

Regarding the relative amounts of water and alcohol, as mentioned hereinabove, it is possible to use all water and no alcohol in the regeneration treatment but at least one lower alcohol is clearly advantageous and preferably is included. The amount of water is at least sufficient to dissolve the amount of carbonate (or bicarbonate) required to obtain the necessary pH taught herein. On the other hand, the water tends to promote reaction to the left of the reversible reaction and therefore should be kept low. The alcohol is advantageous for solubility reasons. An excess however, is wasteful and to be avoided. Thus, the relative amounts of these can be adjusted for any particular case based on routine experimentation bearing these factors in mind aided by the detailed examples.

The regenerated catecholated polymer free of arsenic is easily recovered in the same fashion as the spent catecholated polymer; namely, by any of several conventional means such as filtering for the reasons explained above. After separation of the beads or other particles of dearsenated polymer, they are advantageously dried; for example, by vacuum or warm inert gas stream (eg. $N_2$) to remove substantially all the water therefrom. This procedure may also prove advantageous in some cases of new or fresh catecholated polymer.

The following more detailed illustrative examples will serve to more fully explain the invention. The invention, however, is not limited to the illustrative examples shown.

EXAMPLE

Preparation of Chloromethylated, 10% PS-DVB Beads

The polystyrene-divinylbenzene beads (10% cross-linked, 62. lg) were washed with hot water and methanol and then dried under vacuum at 100° C., for 2 hours. The beads were then swelled in 300 ml of chloroform for 90 minutes under nitrogen gas. To this chloform solution containing 60 ml of chloromethylmethyl ether was added dropwise 15 ml (33 g, 0.128 moles) of stannic chloride dissolved in 10 ml of chloromethylmethyl ether. The reaction mixture was stirrred at room temperature for 1 hour and the remaining chloromethylmethyl ether (24 ml) was added to the reaction mixture and stirred for an additional hour. Then the beads were filtered and washed with 1 liter of a 3:1 dioxane:$H_2O$; 1 liter 3:1 dioxane/3N HCl; 400 ml. 3/1 $H_2O$/dioxane/400 ml of dioxane/$H_2O$; 400 ml. 1/1 dioxane/methanol, and 1 liter of methanol. The beads were then dried under nitrogen gas at 70° C. overnight. The beads were analyzed for chloride ion by ion chromatography to give 2.95 mmoles of chloride per g. of beads. This represents a /10.46% chloride by weight (50% of the aromatic rings were chloromethylated).

Preparation of Polymer-Supported Pendant Catechol Ligands

The 10% cross-linked chloromethylated beads prepared as above (5 g) was swelled in toluene for 2 hours and to this stirring solution was added 4 g. (36.4 m mole) of freshly sublimed catechol and 20 ml (0.171 moles) of stannic chloride dissolved in 30 ml of benzene. The reaction mixture was refluxed for two days and then cooled to room temperature and then washed with 200 ml each of toluene, toluene/dioxane (3:1); toluene/dioxane (1:3); dioxane/$H_2O$ (3:1) dioxane/3N HCl (3:1); $H_2O$/dimethylformamide (3:1); $H_2O$/dimethylformamide (1:3);/methanol/V: dimethylformamide:MEOH (1:3) and dimethylformamide/methanol. The beads were then (Soxhlet) extracted for five days under nitrogen gas using dioxane as solvent. This was followed by washing with 200 ml portions of dimethylformamide/$H_2O$; dimethylformamide/methanol and methanol. The beads were dried at 75° C. under vacuum and stored dry under nitrogen. Analysis via ion chromatography shows 0.158 mmoles of chloride per gram of 1.79 m. moles of catechol per gram (95% of the available chloride sites were substituted with catechol) giving a modified bead with 30.7% by weight of polymer-supported catechol ligands.

Reaction of Phenylarsonic Acid With 10% PS-DVB Beads Modified With Catechol

In a round-bottom two-necked flash equipped with a nitrogen inlet was placed 100 mg of 10% PS-DBB containing 0.279 milliequivalents of catechol along with 28.2 mg (.14 m moles) phenylarsonic acid. The reaction mixture, in 10 ml of benzene, was refluxed for 5 hours under nitrogen atmosphere afterwhich the beads were washed with 20 ml of hot benzene, then 30 ml methanol and dried under vacuumm in a nitrogen stream. The solvents were then evaporated under vacuum and the residue was dissolved in quartz distilled water and analyzed for total arsenic concentration via graphite furnace atomic absorption spectrometry. This provide an arsenic up-take of 3,840 ppm As per gram of beads.

Similar results were obtained in other experiments as shown below in the Table.

TABLE

| As REMOVED FROM SOLUTION USING PS—DVB | | | |
|---|---|---|---|
| Degree of crosslinking (by wt.) | 2% | 10% | 20% |
| Degree of catechol loading (by wt.) | 11% | 30% | about 6% |
| Ppm.* As** Removed By Polymer From Solution | | | |
| Methyl Arsonic Acid (MAA) | 1637 | 2150 | 1490 |
| Phenyl Arsonic Acid (PAA) | 3770 | 3840*** | 1740 |
| Arsenic Acid (AA) | 1590 | 2829 | 930 |

* The ppm. of As is per gram of beads (ppm As/gm)
** The As removed is in three forms.
*** Same experiment as detailed above.

For an illustration of the structures formed by the catechol ligands and arsenic compounds, see *Organometallics*, 1982, 1, 1238, by Richard H. Fish and Raja S. Tannous.

Regeneration by Removal of Arsenic Compounds From Polymer Supported Catechol Ligands In a round-bottom flask with a magnetic stirring bar was placed 11.2 mg of 20% cross-linked PS-DVB containing 19.16 ppm of As as phenylarsonic acid along with 2 ml of 63% aqueous ethanol solution of sodium carbonate. The reaction mixture was stirred for 3 hours at room temperature, after which, the beads were removed and washed with hot water. The sodium carbonate solution and the water solution used to wash the beads were combined and analyzed for arsenic by single cup graphite furnace atomic absorption spectroscopy to provide 65% recovery (12.45 ppm As) of the phenylarsonic acid. Similar reaction with an aqueous ethanol solution of sodium bicarbonate provides another 9% recovery of As or 74% total removal.

If, however, the aqueous ethanol solution containing sodium carbonate is heated to 45°–50° C. with the PS-DVB beads containing 19.16 ppm of As, it was found that 90% of the arsenic could be removed in a first step, and an additional 10% As with sodium bicarbonate in a second step. Thus, a quantitative removal of Arsenic is possible with slight heating of the carbonate and bicarbonate solutions.

Dearsenation of a benzene-phenylarsonic acid was repeated, with the same PS-DVB beads modified with catechol, the reaction of phenylarsonic acid and found quantitative up-take as in the initial reaction. This was followed by the above-mentioned removal procedure was done three times and each time activity remained through each cycle.

The foregoing description of a preferred embodiment of the invention has been presented for purposes of illustration and description. It is not intended to be exhaustive, or to limit the invention to the precise form disclosed, and obviously many modifications and verifications are possible in light of the above teachings. The embodiment(s) was (were) chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. Process for removing arsenic contaminants from petroliferous liquids by contacting said liquid at a temperature of about 20° C. to about 140° C., with a polystyrene-divinylbenzene polymer crosslinked with up to about 20% divinylbenzene and which polymer contains up to about 30% by weight of catechol ligands.

2. Process according to claim 1 wherein said elevated temperature is in the range of about 35° to 140° C.

3. Process according to claim 1 wherein the pressure is about atmospheric.

4. Process according to claim 1 wherein the temperature is in the range of about 60°–80° C.

5. Process according to claim 1 wherein said catecholated polymer contains about 2 to 10% of catechol ligands anchored to said polymer.

6. Process according to claim 1 wherein said petroliferous liquid is shale oil.

7. Process according to claim 1 wherein said petroliferous liquid is heavy petroleum.

* * * * *